US007344387B2

(12) United States Patent
Shiroyama

(10) Patent No.: US 7,344,387 B2
(45) Date of Patent: Mar. 18, 2008

(54) BOARD-TO-BOARD CONNECTOR

(75) Inventor: Yuusuke Shiroyama, Kanagawa (JP)

(73) Assignee: Kyocera Elco Corporation, Kanagawa (JP)

( * ) Notice: Subject to any disclaimer, the term of this patent is extended or adjusted under 35 U.S.C. 154(b) by 0 days.

(21) Appl. No.: 11/758,739

(22) Filed: Jun. 6, 2007

(65) Prior Publication Data

US 2007/0281519 A1 Dec. 6, 2007

(30) Foreign Application Priority Data

Jun. 6, 2006 (JP) ..... 2006-157759

(51) Int. Cl.
*H01R 12/00* (2006.01)

(52) U.S. Cl. ..... 439/74; 439/660

(58) Field of Classification Search ..... 439/74, 439/75, 660, 65, 83, 84
See application file for complete search history.

(56) References Cited

U.S. PATENT DOCUMENTS 5,885,092 A * 3/1999 Ito et al. ..... 439/74
5,975,916 A * 11/1999 Okura ..... 439/74
6,338,630 B1 * 1/2002 Dong ..... 439/83
6,540,561 B1 * 4/2003 Masumoto ..... 439/660
6,623,308 B2 * 9/2003 Ono ..... 439/660
6,764,314 B1 * 7/2004 Lee ..... 439/65
6,793,506 B1 * 9/2004 Hirata et al. ..... 439/74
6,811,411 B1 * 11/2004 Hirata et al. ..... 439/74
7,037,117 B2 * 5/2006 Goto ..... 439/74
7,172,433 B2 * 2/2007 Tsai ..... 439/74
7,247,029 B2 * 7/2007 Chen ..... 439/74
2001/0027036 A1 * 10/2001 Goto ..... 439/74

* cited by examiner

*Primary Examiner*—Briggitte R. Hammond
(74) *Attorney, Agent, or Firm*—McCormick, Paulding & Huber LLP

(57) ABSTRACT

A board-to-board connector includes a receptacle and a plug for inserting into the receptacle. The receptacle includes a receptacle insulator including two opposed side walls and opposed receptacle contacts symmetrically arranged and supported by the two opposed side walls. Each of the two opposed receptacle contacts includes an inverted U-shaped portion and a U-shape-grooved continuity. The plug includes a plug insulator including two opposed insert walls and opposed plug contacts symmetrically arranged and supported by the two opposed insert walls. Each of the two opposed plug contacts includes a U-shaped continuity portion and is inserted into the U-shape-grooved continuity portion to establish electrical connection therewith. When the plug is inserted into the receptacle, the U-shaped continuity portions of the two opposed plug contacts deform the U-shape-grooved continuity portions of the two opposed receptacle contacts resiliently away from the two opposed side walls of the receptacle insulator.

9 Claims, 5 Drawing Sheets

BOARD-TO-BOARD CONNECTOR

CROSS REFERENCE TO RELATED APPLICATION

The present invention is related to and claims priority of the following co-pending application, namely, Japanese Patent Application No. 2006-157759 filed on Jun. 6, 2006.

BACKGROUND OF THE INVENTION

1. Field of the Invention

The present invention relates to a board-to-board connector.

2. Description of the Prior Art

A board-to-board connector is generally provided with a receptacle mounted on one of a pair of boards (e.g., a solid or flexible printed board) and a plug mounted on the other of the pair of boards (e.g., a solid or flexible printed board), wherein the receptacle and the plug are engaged with each other so as to be electrically connected to each other. The receptacle includes an insulator (receptacle insulator) made of synthetic resin and two arrays of receptacle contacts made of metal. The receptacle insulator includes two side wall, and the two arrays of receptacle contacts are symmetrically arranged to correspond to the two side walls of the receptacle insulator. The plug includes an insulator (plug insulator) made of synthetic resin and two arrays of plug contacts made of metal, similar to the receptacle. The plug insulator includes two insert side walls that are inserted between the two side walls of the receptacle insulator, and the two arrays of plug contacts are symmetrically arranged to correspond to the two insertion side walls of the plug insulator. Each receptacle contact includes an inverted U-shaped portion, a connecting leg portion and a U-shape-grooved continuity portion. The inverted U-shaped portion extends along the associated side wall of receptacle insulator, the connecting leg portion extends from one end of the inverted U-shaped portion outside of the associated side wall of receptacle insulator to be fixed to a conductive pattern formed on the associated board, and the U-shape-grooved continuity portion extends from the other end of the inverted U-shaped portion inside the associated side wall of receptacle insulator. The two arrays of plug contacts are supported by the two insert side walls of the plug insulator, respectively, and each plug contact includes a U-shaped continuity portion which is inserted into the U-shape-grooved continuity portion of the associated receptacle contact to establish electrical connection therewith, and a connecting leg portion which extends from the U-shaped continuity portion to be fixed to a conductive pattern formed on the associated board.

Inserting the two insert side walls of the plug insulator of the plug between the two side walls of the receptacle insulator of the receptacle causes the U-shaped continuity portion of each plug contact to enter the U-shaped groove of the U-shape-grooved continuity portion of the associated receptacle contact to thereby establish electrical connection between the U-shaped continuity portion and the U-shape-grooved continuity portion. Consequently, the aforementioned pair of boards (specifically the two arrays of plug contacts and the two arrays of receptacle contacts that are fixed to the pair of boards, respectively) are electrically connected to each other.

In this type of connector, the ease of inserting the plug into the receptacle has deteriorated as a result of the receptacle contacts and the plug contacts being miniaturized to the limit, the contact pitch being reduced to a minimum, the overall structure of the connector being miniaturized to the limit, and the height of the connector being reduced to a minimum. Furthermore, it is generally desired that only a small force be required when the plug is inserted into the receptacle and that a great force be required when the plug is extracted from the receptacle. However, it is an antimonic concept to achieve these two requirements at the same time.

SUMMARY OF THE INVENTION

The present invention provides a board-to-board connector in which the plug can be easily inserted into the receptacle.

The present invention further provides a board-to-board connector, wherein the plug can be inserted into the receptacle by a relatively small force, and further wherein the plug needs to be extracted from the receptacle by a relatively great force when extracted from the receptacle (the force required to disengage the plug from the receptacle is great).

According to an aspect of the present invention, a connector is provided, a board-to-board connector is provided, including a receptacle and a plug which is inserted into the receptacle. The receptacle includes a receptacle insulator including two opposed side walls; and at least two opposed receptacle contacts, which are connected to a first board, symmetrically arranged and supported by the two opposed side walls, respectively; wherein each of the two opposed receptacle contacts includes an inverted U-shaped portion which is shaped along an outer surface of associated one of the two opposed side walls, and a U-shape-grooved continuity portion which extends from an end of the inverted U-shaped portion inside the associated one of the two opposed side walls. The plug includes a plug insulator including two opposed insert walls which are to be inserted between the two opposed side walls of the receptacle insulator, and at least two opposed plug contacts, which are connected to a second board, symmetrically arranged and supported by the two opposed insert walls, respectively; wherein each of the two opposed plug contacts includes a U-shaped continuity portion which is shaped along an outer surface of associated one of the two opposed insert walls to be supported thereby, and is inserted into the U-shape-grooved continuity portion to establish electrical connection therewith; and wherein the two opposed insert walls of the plug insulator are positioned so that, when the two opposed insert walls of the plug insulator are inserted between the opposed side walls of the receptacle insulator, the U-shaped continuity portions of the two opposed plug contacts deform the U-shape-grooved continuity portions of the two opposed receptacle contacts resiliently in directions to move away from the two opposed side walls of the receptacle insulator, respectively.

It is desirable for a distance between the outer surfaces of the U-shaped continuity portions of the two opposed plug contacts to be smaller than a distance between inner surfaces of the U-shape-grooved continuity portions of the two opposed receptacle contacts in free states thereof.

It is desirable for the U-shape-grooved continuity portion of each of the two opposed receptacle contacts and the U-shaped continuity portion of each of the two opposed plug contacts to include a receptacle protrusion and a plug protrusion, respectively, which are engaged with each other when the plug is inserted into the receptacle.

It is desirable for the receptacle protrusion and the plug protrusion to be positioned between one of the two opposed side walls and associated one of the two opposed insert walls in a state where the plug is inserted into the receptacle.

It is desirable for an amount of engagement between the plug protrusion and the receptacle protrusion to increase upon resilient deformation of the U-shape-grooved continuity portion.

It is desirable for the U-shaped continuity portion of each of the two opposed plug contacts to include a second plug protrusion which is engaged with a portion of the U-shape-grooved continuity portion of associated one of the two opposed receptacle contacts which is positioned away from associated one of the two opposed side walls when the plug is inserted into the receptacle.

It is desirable for the two opposed receptacle contacts to be resiliently deformed in opposite directions to approach each other when the plug is inserted into the receptacle.

It is desirable for the receptacle insulator to include a central raised portion positioned between the two opposed side walls, the two opposed receptacle contacts being resiliently deformed toward the central raised portion when the plug is inserted into the receptacle.

It is desirable for the receptacle to include two arrays of the receptacle contacts supported by the two opposed side walls, respectively, and for the plug to include two arrays of the plug contacts supported by the two opposed insert walls, respectively.

According to the present invention, a board-to-board connector which excels in ease of inserting the plug into the receptacle is achieved. Moreover, according to the present invention, a board-to-board connector is achieved wherein the plug can be inserted into the receptacle by a force and wherein the plug needs to be extracted from the receptacle by a great force when extracted from the receptacle.

BRIEF DESCRIPTION OF THE DRAWINGS

The present invention will be discussed below in detail with reference to the accompanying drawings, in which.

DESCRIPTION OF THE PREFERRED EMBODIMENT

Figure 1:
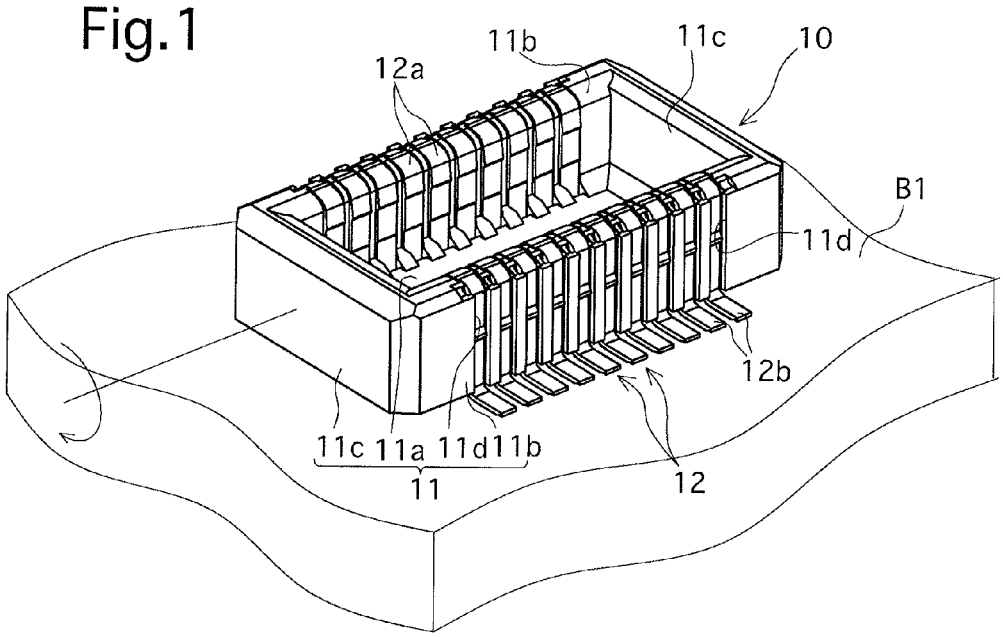
FIG. 1 is a perspective view of a plug of a board-to-board connector, according to an embodiment of the present invention.
Figure 2:
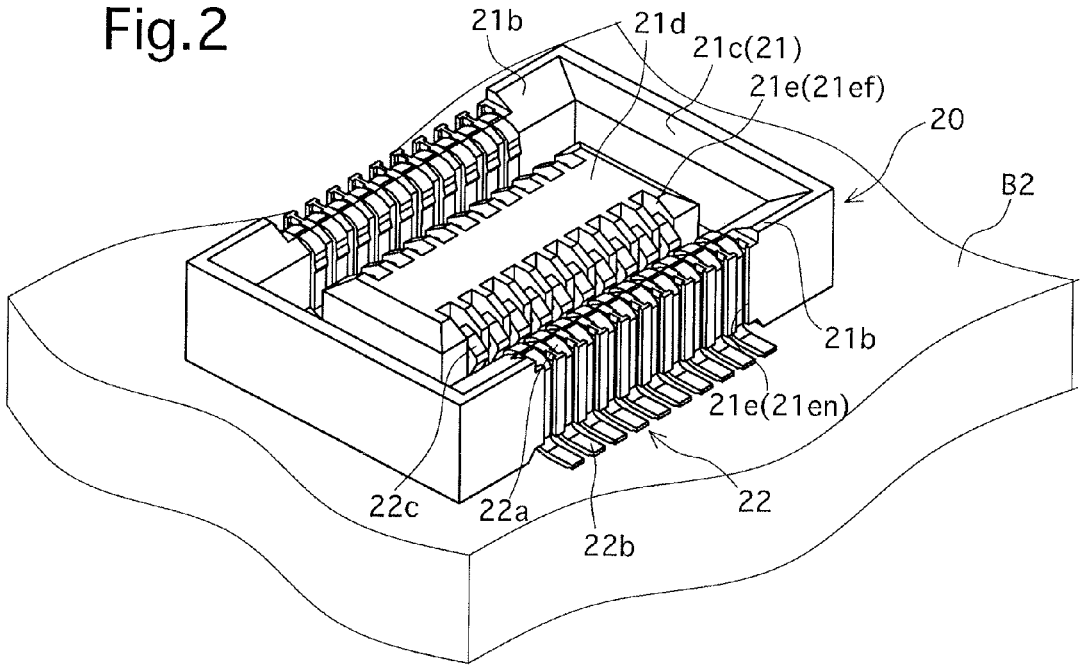
FIG. 2 is a perspective view of a receptacle of the board-to-board connector, according to the embodiment of the present invention, into which the plug shown in FIG. 1 is inserted.
Figure 3:
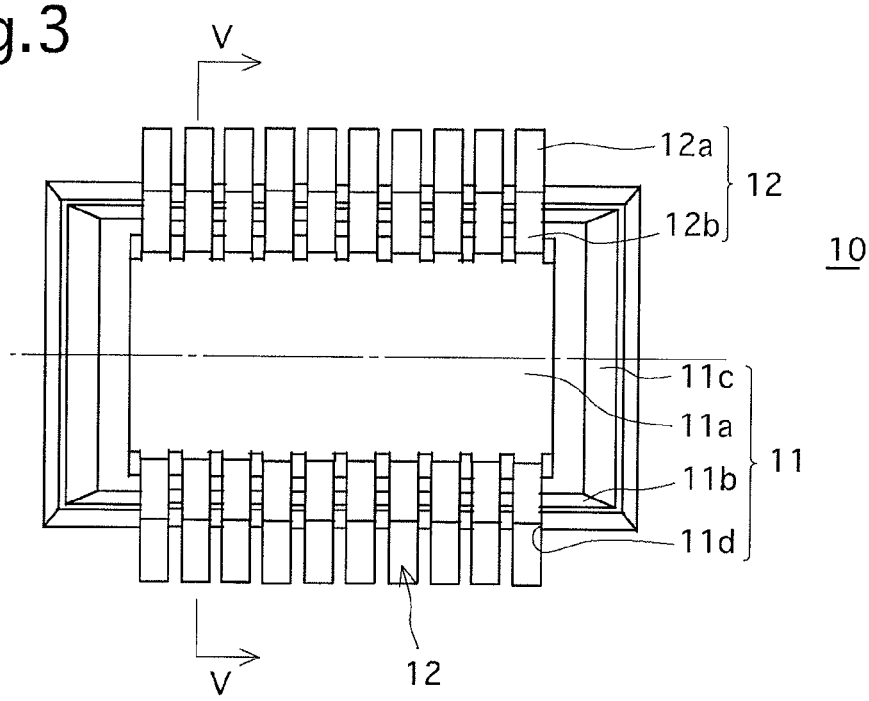
FIG. 3 is a plan view of the plug shown in FIG. 1.
Figure 4:
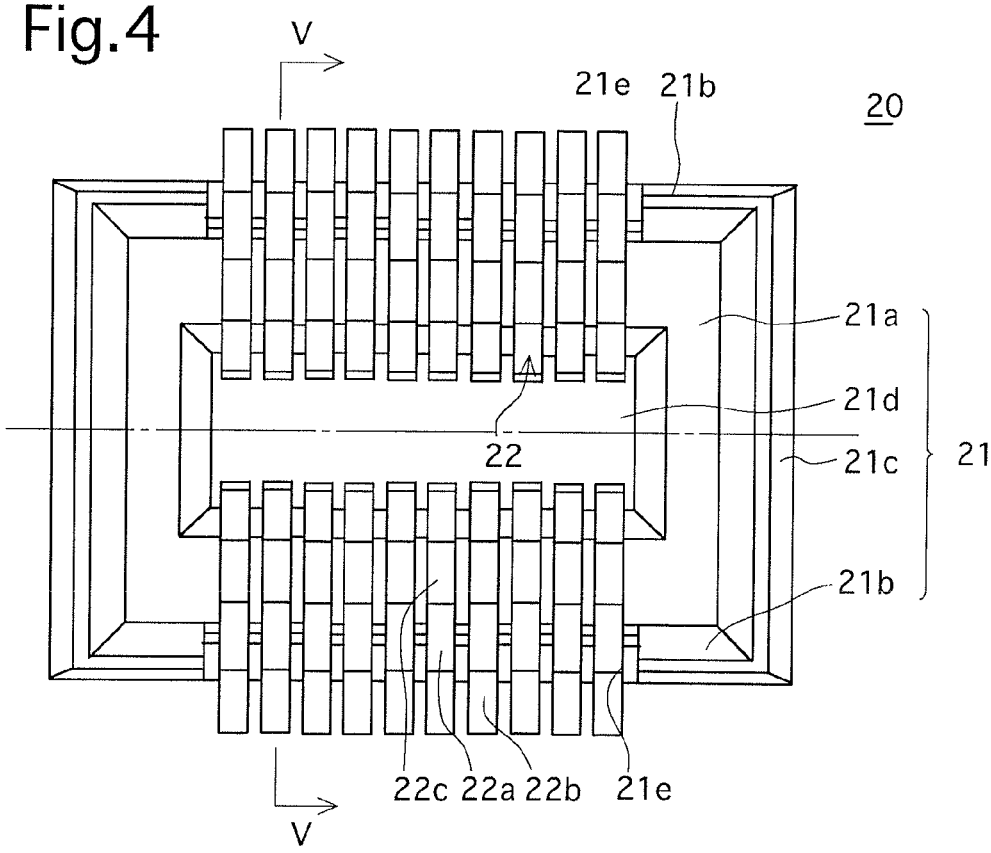
FIG. 4 is a plan view of the receptacle shown in FIG. 2.

An embodiment of a connector according to the present invention is composed of a plug 10 shown in FIGS. 1 and 3 and a receptacle 20 shown in FIGS. 2 and 4.

The plug 10 is provided with a plug insulator 11 made of synthetic resin (heat-resistant and electrical-insulating resin) and a plurality of plug contacts 12, specifically, two arrays of plug contacts 12. Each plug contact 12 is made of metal (copper) and supported by the plug insulator 11. The plug insulator 11 is provided with a rectangular base 11*a*, a pair of long side walls (insert walls) 11*b* parallel to each other which extend uprightly from corresponding long sides of the base 11*a*, respectively, and a pair of short side walls 11*c* parallel to each other which extend uprightly from corresponding short sides of the base 11*a*, respectively. Two arrays of contact accommodation grooves 11*d* are made in the pair of long side walls 11*b*, respectively, with a constant pitch to be symmetrical with respect to a central line between the pair of long side walls 11*b*.

Figure 5:
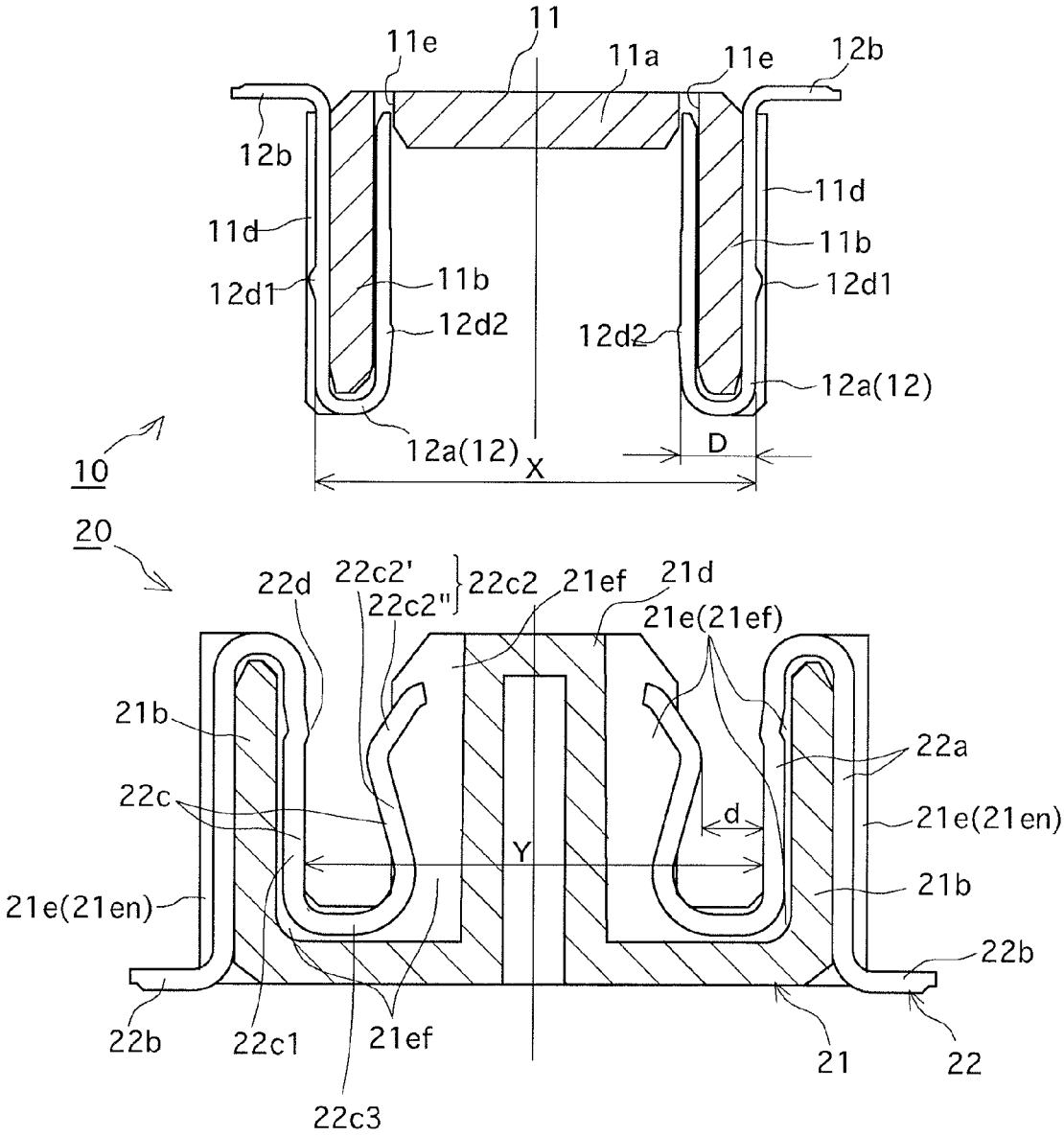
FIG. 5 is a cross sectional view of the plug shown in FIGS. 1 and 3 and the receptacle shown in FIGS. 2 and 4 in a disengaged state thereof, taken along the V-V line in FIG. 3 and the V-V line in FIG. 4, respectively.
Figure 6:
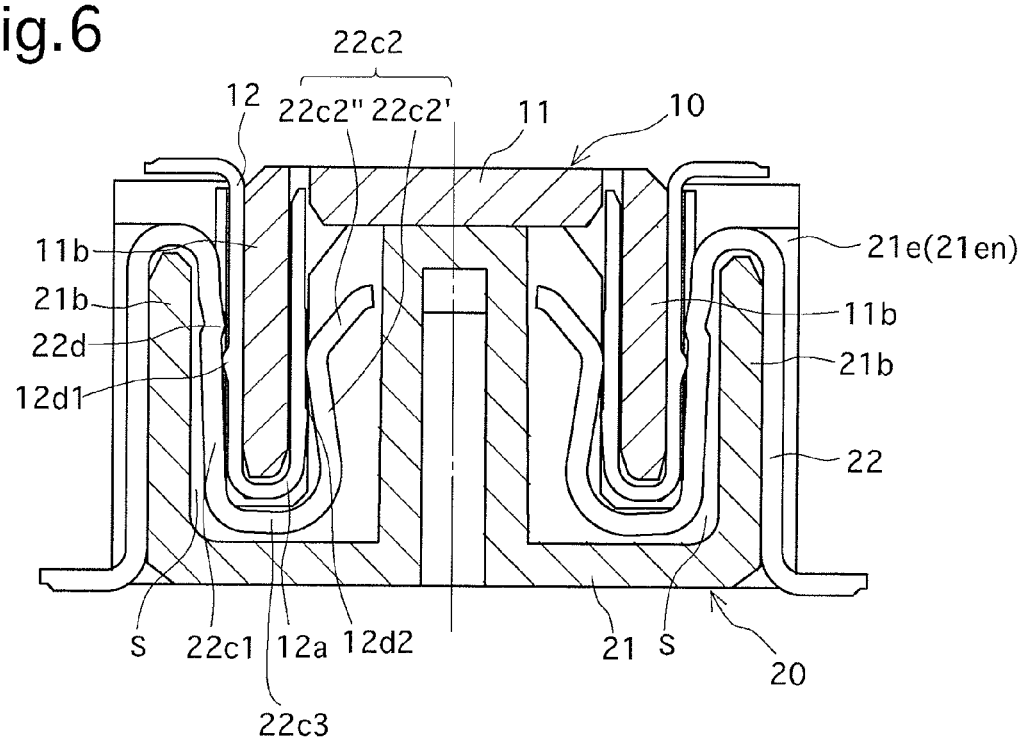
FIG. 6 is a cross sectional view of the plug shown in FIGS. 1 and 3 and the receptacle shown in FIGS. 2 and 4 in an engaged state thereof, taken along the V-V line in FIG. 3 and the V-V line in FIG. 4, respectively.
Figure 7A:
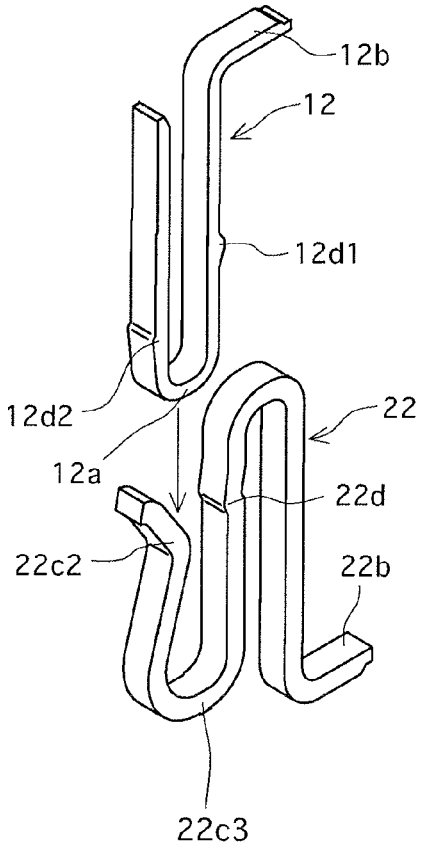
FIG. 7A is a perspective view of a plug contact of the plug shown in FIGS. 1 and 3 and an associated receptacle contact of the receptacle shown in FIGS. 2 and 4 in a state immediately before the plug contact is engaged with the receptacle contact.
Figure 7B:
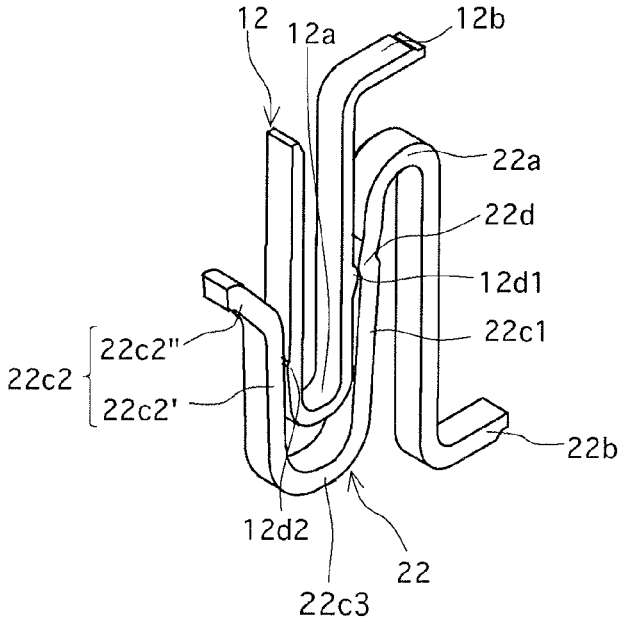
FIG. 7B is a perspective view of the plug contact and the receptacle contact shown in FIG. 7B in a state where the plug contact is engaged with the receptacle contact.

Each array of plug contacts 12 are fitted in the associated array of contact accommodation grooves lid, respectively, to be supported by the associated long side wall 11*b* of the plug insulator 11, and the two arrays of plug contacts 12 are bilaterally symmetrical in shape. As shown in FIGS. 5 through 7, each plug contact 12 is provided with a U-shaped continuity portion 12*a* and a connecting leg portion 12*b*. The U-shaped continuity portion 12*a* is shaped along the outer surface, the end surface (the bottom end surface as viewed in FIG. 5) and the inner surface of the associated long side wall 11*b*. The connecting leg portion 12*b* extends from one end of the U-shaped continuity portion 12*a* outside of the associated long side wall 11*b*. The connecting leg portion 12*b* is angled relative to the U-shaped continuity portion 12*a* to be soldered to a conductive terminal pattern (not shown) formed on an associated board B1 (shown in FIG. 1). The plug insulator 11 is provided with two arrays of support holes (through holes) 11*e* (see FIG. 5) in which free ends of the two arrays of plug contacts 12 are inserted and positioned, respectively. Each support hole 11*e* can be either a through hole or a bottomed hole. Each plug contact 12 is positioned in the associated contact accommodation groove 11*d* and support hole 11*e* to be fixed thereto so as not to be elastically deformed as viewed macroscopically. The U-shaped continuity portion 12*a* is provided, on the outer surface side of the associated long side wall 11*b*, with a first protrusion (first plug protrusion) 12*d*1 which projects in a direction away from the other long side wall 11*b*, and is further provided, on the inner surface side of the long side wall 11*b*, with a second protrusion (second plug protrusion) 12*d*2 which projects in a direction toward the other long side wall 11*b*. The two arrays of plug contacts 12 can be formed integral with the insulator 11 by insertion molding.

The receptacle 20 is provided with a receptacle insulator 21 made of synthetic resin (heat-resistant and electrical-insulating resin) and a plurality of receptacle contacts 22, specifically two arrays of receptacle contacts 22. Each receptacle contact 22 is made of metal (copper) and supported by the receptacle insulator 21. The receptacle insulator 21 is provided with a rectangular base 21*a*, a pair of long side walls 21*b* parallel to each other which extend uprightly from corresponding long sides of the base 21*a*, respectively, a pair of short side walls 21*c* parallel to each other which extend uprightly from corresponding short sides of the base 21*a*, respectively, and a central raised portion 21*d* which is rectangular in plan view and surrounded by the pair of long side walls 21*b* and the pair of short side walls 21*c* to be positioned at a center of the pair of long side walls 21*b* and the pair of short side walls 21*c*. The pair of long side walls 11*b* and the pair of short side walls 11*c* are inserted into a rectangular groove (which defines the base 21*a*) formed around the central raised portion 21*d* between the central raised portion 21*d* and the four side walls 21*b* and 21*c*.

Two arrays of contact accommodation grooves 21*e* are provided in the receptacle insulator 21 with a constant pitch to be bilaterally symmetrical with respect to a central line between the pair of long side walls 21*b*. More specifically, one of the two arrays of contact accommodation grooves 21*e* extend from the outer surface of one of the pair of long side walls 21*b* to the central raised portion 21*d* via the base 21*a*, while the other array of contact accommodation grooves 21*e* extend from the outer surface of the other long side wall 21*b* to the central raised portion 21*d* via the base 21*a*. A portion of each contact accommodation groove 21*e* which is positioned on the outer surface of the associated long side wall 21*b* is formed as a narrow groove 21*en* to prevent a portion of the receptacle contact 22 which is positioned therein from moving microscopically, and the remaining portion of each contact accommodation groove 21*e* is formed as a wide groove 21*ef* which allows a portion of the receptacle contact 22 which is positioned therein to be resiliently deformed in the wide groove 21*ef*.

As shown in FIGS. 5 through 7, each receptacle contact 22 is provided with an inverted U-shaped portion 22*a*, a connecting leg portion 22*b* and a U-shape-grooved continuity portion 22*c*. The inverted U-shaped portion 22*a* is shaped along the outer surface, the end surface (the top end surface as viewed in FIG. 5) and the inner surface of the associated long side wall 21*b*, the connecting leg portion 22*b* extends from one end of the inverted U-shaped portion 22*a* outside of the associated long side wall 21*b*, and the U-shape-grooved continuity portion 22*c* extends from the other end of the inverted U-shaped portion 22*a* inside the associated long side wall 21*b*. The connecting leg portion 22*b* is angled relative to the inverted U-shaped portion 22*a* to be soldered to a conductive terminal pattern (not shown) formed on an associated board B2 (shown in FIG. 2). A portion of the inverted U-shaped portion 22*a* which extends along the inner surface of the associated long side wall 21*b* also serves as a part of the U-shape-grooved continuity portion 22*c*. Each receptacle contact 22 that has the above described structure is substantially fixed to the narrow groove 21*en* of the associated long side wall 21*b*, which is formed on the outer surface thereof, and is freely resiliently deformable in the wide groove 21*ef* of the associated long side wall 21*b*.

The U-shape-grooved continuity portion 22*c* of each receptacle contact 22 is provided with a near-sidewall portion 22*c*1 positioned in the close vicinity of the associated long side wall 21*b* therealong, an inner portion 22*c*2 positioned away from the associated long side wall 21*b*, and a U-shaped bottom portion 22*c*3 which connects lower ends of the near-sidewall portion 22*c*1 and the inner portion 22*c*2. The near-sidewall portion 22*c*1 in a free state extends parallel to the associated long side wall 21*b* of the receptacle insulator 21. On the other hand, the inner portion 22*c*2 is V shaped, including an outwardly-inclined portion 22*c*2' and an inwardly-inclined portion (inwardly-inclined guide portion) 22*c*2". The outwardly-inclined portion 22*c*2' is inclined toward the near-sidewall portion 22*c*1 from the U-shaped bottom portion 22*c*3 upwards, and the inwardly-inclined portion 22*c*2", is inclined toward the central raised portion 21*d*, in a direction away from the near-sidewall portion 22*c*1, from the upper end of the outwardly-inclined portion 22*c*2' upwards. The near-sidewall portion 22*c*1 is provided with a protrusion (receptacle protrusion) 22*d* in association with the first protrusion 12*d*1 of the associated plug contact 12. A minimum distance (spacing) d (see FIG. 5) between the near-sidewall portion 22*c*1 and the inner portion 22*c*2 of each receptacle contact 22 in a free state is predetermined to be smaller than a width D (see FIG. 5) of the U-shaped continuity portion 12*a* with neither the protrusion 22*d* of the near-sidewall portion 22*c*1 nor the first and second protrusions 12*d*1 and 12*d*2 being taken into account.

The positions of the pair of long side walls 11*b* of the plug insulator 11 are determined so as to resiliently deform the U-shape-grooved continuity portion 22*c* of each receptacle contact 22 inward (toward the central raised portion 21*d*) when the pair of long side walls 11*b* are inserted between the pair of long side walls 21*b* of the receptacle insulator 21. Namely, a distance X (see FIG. 5) between the outer surfaces of the U-shaped continuity portions 12*a* of the two opposed plug contacts 12 is determined to be smaller than a distance Y (see FIG. 5) between the inner surfaces of the near-sidewall portions 22*c*1 of the two opposed receptacle contacts 22 in free states thereof. Upon the pair of long side walls 11*b* being inserted between the pair of long side walls 21*b* of the receptacle insulator 21, the near-sidewall portion 22*c*1 of each receptacle contact 22 is resiliently deformed in a direction away from the associated long side wall 21*b* of the receptacle insulator 21, so that the U-shape-grooved continuity portion 22*c* is resiliently deformed in the same direction (see FIGS. 6, 7A and 7B). Namely, the gap between the U-shape-grooved continuity portion 22*c* of each receptacle contact 22 and the associated long side wall 21*b* of the receptacle insulator (specifically, between the near-sidewall portion 22*c*1 of the U-shape-grooved continuity portion 22*c* and the inner surface of the associated long side wall 21*b*) becomes a tapered gap S (see FIG. 6) the width of which tapers in a direction away from the base 21*a* of the plug insulator 11 (upward as viewed in FIG. 6). Accordingly, even if the plug 10 is inserted into the receptacle 20 with a slight relative positional deviation therebetween, the plug 10 and the receptacle 20 can be easily engaged with each other by a relatively small force.

Additionally, inserting the pair of long side walls 11*b* of the plug insulator 11 between the pair of long side walls 21*b* of the receptacle insulator 21 causes the U-shaped continuity portion 12*a* of each plug contact 12 to open the near-sidewall portion 22*c*1 and the inner portion 22*c*2 of the associated receptacle contact 22 so as to increase the gap therebetween, and further inserting the pair of long side walls 11*b* of the plug insulator 11 to the limit between the pair of long side walls 21*b* of the receptacle insulator 21 causes the first protrusion 12*d*1 of each plug contact 12 to ride over the protrusion 22*d* of the associated receptacle contact 22, and simultaneously causes the second protrusion 12*d*2 of each plug contact 12 to ride over the inwardly-inclined portion 22*c*2" of the associated receptacle contact 22 to be engaged with the outwardly-inclined portion 22*c*2' at a position thereon in the vicinity of the upper end thereof. Hence, a tactile "click" can be felt during the inserting operation of the plug into the receptacle.

Figure 8:
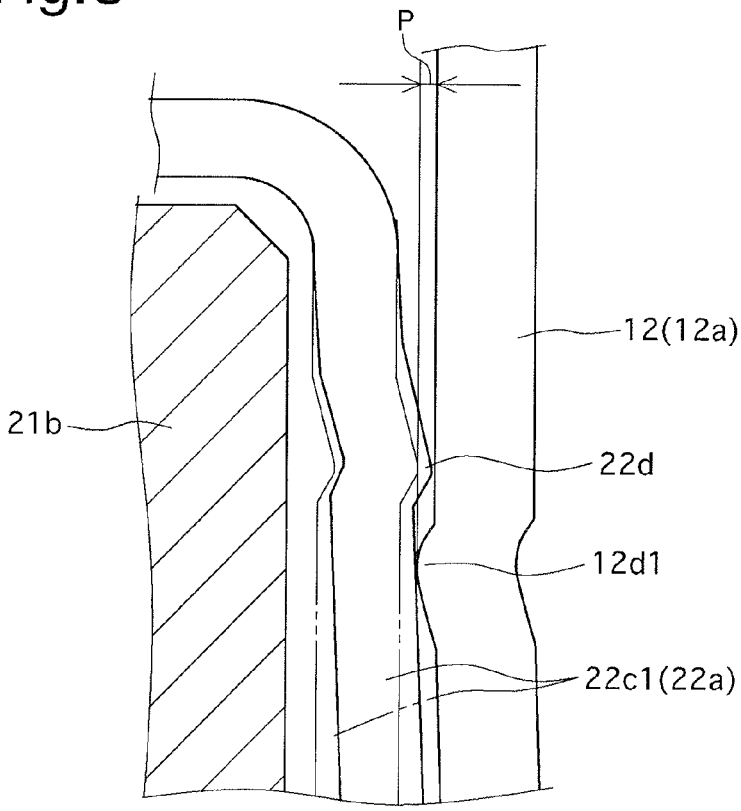
FIG. 8 is a cross sectional view of a portion of the connector shown in FIG. 6.

Additionally, the force required to extract the plug 10 from the receptacle 20 is larger than the force required to insert the plug 10 into the receptacle 20 because the U-shape-grooved continuity portion 22*c* of each receptacle contact 22 is resiliently deformed in a direction away from the associated long side wall 21*b* as shown in FIG. 8 to thereby increase an amount of engagement P (see FIG. 8) between the protrusion 22*d* and the first protrusion 12*d*1 in a state where the plug 10 is inserted into the receptacle 20.

In addition, when the plug 10 is extracted from the receptacle 20, the first protrusion 12*d*1 of each plug contact 12 presses the currently resiliently-deformed near-sidewall portion 22*c*1 of the associated receptacle contact 22 toward the associated long side wall 21*b*. Thereupon, the contact pressure of the inner portion 22*c*2 of the U-shape-grooved continuity portion 22*c* (i.e., the V-shaped bent portion between the outwardly-inclined portion 22*c*2' and the inwardly-inclined portion 22*c*2") of each receptacle contact 22 on the associated plug contact 12 increases and also the friction between the inner portion 22*c*2 of the U-shape-grooved continuity portion 22*c* and the associated plug contact 12 increases, which also increases the force required to extract the plug 10 from the receptacle 20.

Obvious changes may be made in the specific embodiment of the present invention described herein, such modifications being within the spirit and scope of the invention claimed. It is indicated that all matter contained herein is illustrative and does not limit the scope of the present invention.

What is claimed is:

1. A board-to-board connector including a receptacle and a plug which is inserted into said receptacle, wherein said receptacle comprises a receptacle insulator including two opposed side walls; and at least two opposed receptacle contacts, which are connected to a first board, symmetrically arranged and supported by said two opposed side walls, respectively; wherein each of said two opposed receptacle contacts includes an inverted U-shaped portion which is shaped along an outer surface of associated one of said two opposed side walls, and a U-shape-grooved continuity portion which extends from an end of said inverted U-shaped portion inside said associated one of said two opposed side walls; and wherein said plug comprises a plug insulator including two opposed insert walls which are to be inserted between said two opposed side walls of said receptacle insulator, and at least two opposed plug contacts, which are connected to a second board, symmetrically arranged and supported by said two opposed insert walls, respectively; wherein each of said two opposed plug contacts includes a U-shaped continuity portion which is shaped along an outer surface of associated one of said two opposed insert walls to be supported thereby, and is inserted into said U-shape-grooved continuity portion to establish electrical connection therewith; and wherein said two opposed insert walls of said plug insulator are positioned so that, when said two opposed insert walls of said plug insulator are inserted between said opposed side walls of said receptacle insulator, said U-shaped continuity portions of said two opposed plug contacts deform said U-shape-grooved continuity portions of said two opposed receptacle contacts resiliently in directions to move away from said two opposed side walls of said receptacle insulator, respectively.

2. The board-to-board connector according to claim 1, wherein a distance between the outer surfaces of the U-shaped continuity portions of the two opposed plug contacts is smaller than a distance between inner surfaces of said U-shape-grooved continuity portions of said two opposed receptacle contacts in free states thereof.

3. The board-to-board connector according to claim 1, wherein said U-shaped continuity portion of each of said two opposed plug contacts comprises a second plug protrusion which is engaged with a portion of said U-shape-grooved continuity portion of associated one of said two opposed receptacle contacts which is positioned away from associated one of said two opposed side walls when said plug is inserted into said receptacle.

4. The board-to-board connector according to claim 1, wherein said receptacle comprises two arrays of said receptacle contacts supported by said two opposed side walls, respectively, and wherein said plug comprises two arrays of said plug contacts supported by said two opposed insert walls, respectively.

5. The board-to-board connector according to claim 1, wherein said U-shape-grooved continuity portion of each of said two opposed receptacle contacts and said U-shaped continuity portion of each of said two opposed plug contacts comprise a receptacle protrusion and a plug protrusion, respectively, which are engaged with each other when said plug is inserted into said receptacle.

6. The board-to-board connector according to claim 5, wherein said receptacle protrusion and said plug protrusion are positioned between one of said two opposed side walls and associated one of said two opposed insert walls in a state where said plug is inserted into said receptacle.

7. The board-to-board connector according to claim 5, wherein an amount of engagement between said plug protrusion and said receptacle protrusion increases upon resilient deformation of said U-shape-grooved continuity portion.

8. The board-to-board connector according to claim 1, wherein said two opposed receptacle contacts are resiliently deformed in opposite directions to approach each other when said plug is inserted into said receptacle.

9. The board-to-board connector according to claim 8, wherein said receptacle insulator comprises a central raised portion positioned between said two opposed side walls, said two opposed receptacle contacts being resiliently deformed toward said central raised portion when said plug is inserted into said receptacle.

* * * * *